US011663951B2

(12) United States Patent
Park et al.

(10) Patent No.: US 11,663,951 B2
(45) Date of Patent: May 30, 2023

(54) DEMURA COMPENSATION DEVICE AND DATA PROCESSING CIRCUIT FOR DRIVING DISPLAY PANEL

(71) Applicant: LX Semicon Co., Ltd., Daejeon (KR)

(72) Inventors: Jun Young Park, Daejeon (KR); Do Yeon Kim, Daejeon (KR); Min Ji Lee, Daejeon (KR); Gang Won Lee, Daejeon (KR); Young Kyun Kim, Daejeon (KR); Ji Won Lee, Daejeon (KR)

(73) Assignee: LX SEMICON CO., LTD., Daejeon (KR)

( * ) Notice: Subject to any disclaimer, the term of this patent is extended or adjusted under 35 U.S.C. 154(b) by 0 days.

(21) Appl. No.: 17/531,130

(22) Filed: Nov. 19, 2021

(65) Prior Publication Data

US 2022/0165201 A1 May 26, 2022

(30) Foreign Application Priority Data

Nov. 20, 2020 (KR) ..... 10-2020-0156209

(51) Int. Cl.
*G09G 3/20* (2006.01)

(52) U.S. Cl.
CPC ..... *G09G 3/2007* (2013.01); *G09G 2310/027* (2013.01); *G09G 2320/0233* (2013.01); *G09G 2320/0276* (2013.01); *G09G 2330/028* (2013.01); *G09G 2360/16* (2013.01)

(58) Field of Classification Search
CPC ..... G09G 2310/027; G09G 2320/0233; G09G 2320/0276; G09G 2330/028; G09G 2360/16; G09G 3/2007
See application file for complete search history.

(56) References Cited

U.S. PATENT DOCUMENTS

| | | | | |
|---|---|---|---|---|
| 7,375,854 | B2 * | 5/2008 | Hsu | H04N 5/202 358/1.9 |
| 9,691,337 | B2 | 6/2017 | Kim et al. | |
| 2005/0201615 | A1 * | 9/2005 | Hsu | H04N 9/69 358/1.9 |
| 2011/0150356 | A1 * | 6/2011 | Jo | G06T 5/002 382/269 |
| 2014/0307002 | A1 * | 10/2014 | Lee | G09G 3/2096 345/77 |
| 2015/0206485 | A1 * | 7/2015 | Kim | G09G 3/3607 345/89 |
| 2021/0407371 | A1 * | 12/2021 | Huang | G09G 3/20 |

FOREIGN PATENT DOCUMENTS

| | | | |
|---|---|---|---|
| JP | 6576018 | B2 | 9/2019 |
| KR | 102144577 | B1 | 8/2020 |

* cited by examiner

*Primary Examiner* — kenneth bukowski
(74) *Attorney, Agent, or Firm* — Rothwell, Figg, Ernst & Manbeck, P.C.

(57) ABSTRACT

Provided is a technology for resolving a mura phenomenon in a display panel to which gamma is applied, in which demura compensation values are generated in a log domain to improve a problem of nonlinearity due to gamma.

13 Claims, 6 Drawing Sheets

DEMURA COMPENSATION DEVICE AND DATA PROCESSING CIRCUIT FOR DRIVING DISPLAY PANEL

CROSS REFERENCE TO RELATED APPLICATION

This application claims priority from Korean Patent Application No. 10-2020-0156209, filed on Nov. 20, 2020, which is hereby incorporated by reference for all purposes as if fully set forth herein.

BACKGROUND OF THE DISCLOSURE

Field of the Disclosure

The present disclosure relates to a technique for solving a mura phenomenon in display panels.

Related Art

A plurality of pixels are arranged on a display panel, and an image is formed on the display panel according to luminance of each pixel. The luminance of each pixel is controlled according to grayscale values, and a driving device for the display panel generates a data voltage to be supplied to each pixel according to the grayscale values. Also, luminance of each pixel is controlled by adjusting a light emitting device, e.g., an organic light emitting diode (OLED), or an open element, e.g., liquid crystal (LC), according to a data voltage.

One of the important factors determining image quality in a driving method of the display panel is uniformity of luminance. If luminance is not uniform, the image quality of the display panel is recognized to be low. When the same grayscale values are applied to a plurality of pixels disposed on the display panel, deviations of luminance appearing between the pixels may be a factor lowering the image quality.

However, most display panels basically have deviations in luminance due to manufacturing problems or problems in the arrangement of pixels. Such deviation in luminance is also called mura. If the pixels of the display panel to which compensation is not applied are driven with the same grayscale values, an image of a single color may not be displayed and an image having a pattern such as a blemish may rather be displayed. An image having a pattern such as the blemish occurs due to a luminance deviation of each pixel.

In order to eliminate the mura, a number of demura compensation devices have been developed. However, the demura compensation devices have problems in that a process of calculating a compensation value is complicated and accuracy is low. This problem appears because gamma is applied to the display panel.

Gamma is applied to display panels to reflect human visual characteristics. The application of gamma makes a relationship between the grayscale values and the luminance values non-linear, and calculation of compensation values is complicated and accuracy thereof is lowered according to the non-linear relationship.

SUMMARY OF THE DISCLOSURE

The present disclosure provides a Demura compensation technology having high accuracy without complicating a calculation process.

In an aspect, a demura compensation device includes a reception circuit configured to acquire a plurality of luminance values corresponding to a plurality of grayscale values for one area of a display panel to which gamma is applied; and a calculation circuit configured to calculate compensation values for the grayscale values by mapping the plurality of luminance values to a log domain so that a mura phenomenon due to a difference between target luminance values and the plurality of luminance values is resolved.

In another aspect, a data processing circuit includes: a reception circuit configured to receive image data including grayscale values for each pixel arranged in a display panel; a memory configured to store compensation values for the grayscale values for each area; a compensation circuit configured to compensate for the grayscale values according to the compensation values and generate converted image data with the compensated grayscale values; and a transmission circuit configured to transmit the converted image data to a source driver, wherein the compensation values are values calculated by mapping luminance values for the display panel to a log domain.

As described above, according to the present embodiment, demura compensation values may be accurately calculated through an uncomplicated process.

DESCRIPTION OF EXEMPLARY EMBODIMENTS

Figure 1:
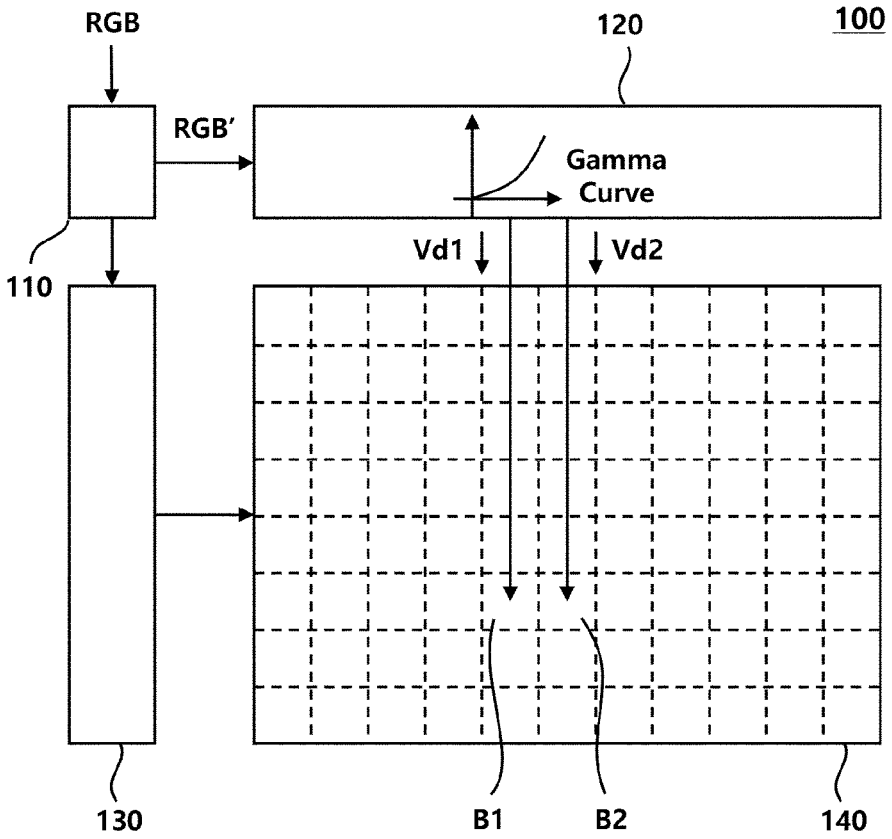
FIG. 1 is a configuration diagram of a display device according to an embodiment.

FIG. 1 is a block diagram of a display device according to an embodiment.

Referring to FIG. 1, the display device 100 may include a data processing circuit 110, a source driver 120, a gate driver 130, a display panel 140, and the like.

A plurality of pixels may be arranged on the display panel 140. In addition, the plurality of pixels may be grouped into a plurality of areas. For the sake of convenience of description, each area having a form of a block will be described hereinafter.

For the description of an embodiment, a first area B1 and a second area B2 are indicated in FIG. 1. Each of the first area B1 and the second area B2 may include N×M (N and M are natural numbers) pixels. For example, each of the first area B1 and the second area B2 may include 4×4 pixels. The first area B1 and the second area B2 may be disposed adjacent to each other and may have different luminance characteristics. For example, the pixels of the first area B1 and the pixels of the second area B2 may have different luminance values with respect to the same grayscale value.

The data processing circuit 110 may compensate for the grayscale values included in image data RGB to resolve a difference in luminance for each area and generate image data RGB' converted with the compensated grayscale values.

The data processing circuit 110 may store compensation values for each area and compensate for a grayscale value of each pixel using the compensation values. Storing the compensation values for each area is to minimize a storage capacity of the compensation values, and according to an embodiment, the compensation values may be stored for each pixel.

The data processing circuit 110 may transmit the converted image data RGB' to the source driver 120.

In addition, the data processing circuit 110 may transmit a control signal, e.g., a timing control signal, to the source driver 120. The data processing circuit 110 may also transmit a control signal, e.g., a timing control signal to the gate driver 130. In terms of controlling timings of the source driver 120 and the gate driver 130 using such a control signal, the data processing circuit 110 may also be referred to as a timing controller.

The source driver 120 may control luminance of the pixels arranged in the display panel 140 using the converted image data RGB'.

The converted image data RGB' includes a grayscale value for each pixel, i.e., a grayscale value to which a compensation value is actually applied, and the source driver 120 may generate a data voltage according to the grayscale value and supply the generated data voltage to each pixel. For example, the source driver 120 may supply a first data voltage Vd1 to one pixel of the first area B1 and apply a second data voltage Vd2 to one pixel of the second area B2.

The source driver 120 may supply a data voltage, to which gamma is applied, to each pixel to reflect human visual characteristics.

The source driver 120 may include a digital-to-analog converter (DAC) converting a grayscale value into a data voltage. In addition, gamma may be applied to the DAC.

The DAC may be supplied with a plurality of gamma voltages corresponding to 2.0 to 2.8 gammas. In addition, the DAC may select one of a plurality of gamma voltages according to a grayscale value and output the selected gamma voltage as a data voltage.

A gamma voltage circuit generating a plurality of gamma voltages may be disposed in the source driver 120 or may be disposed in a separate device.

The plurality of gamma voltages may form a gamma curve, to which a 2.2 gamma may be applied. Since gamma is applied in the form of an exponent, the gamma curve may have a form of a non-linear exponential function.

Meanwhile, a demura compensation device may be used to generate the compensation values used in the data processing circuit 110. The demura compensation device may image the display panel and generate compensation values for each area using the imaged data. In this case, since gamma has been applied to the display panel, the demura compensation device may apply inverse gamma to the imaged data and calculate compensation values using the imaged data to which the inverse gamma has been applied. The demura compensation device may map luminance values included in the imaged data to a log domain in order to apply the inverse gamma. Also, the demura compensation device may calculate compensation grayscale values logged in the log domain and apply inverse log to the calculated values to calculate final compensation grayscale values. In addition, the demura compensation device may generate compensation values according to the compensation grayscale values. In the log domain, a gamma curve is linearized, and thus, the calculation may be simplified and accurate.

Figure 2:
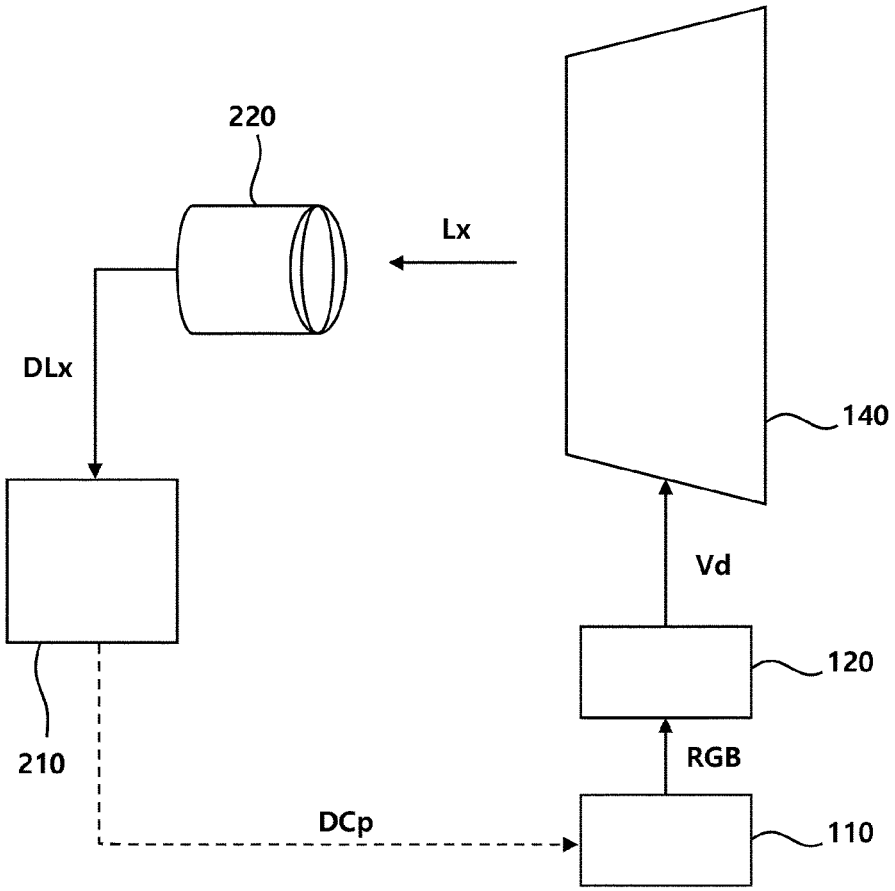
FIG. 2 is a diagram illustrating a signal flow of a demura compensation process according to an embodiment.

FIG. 2 is a diagram illustrating a signal flow of a demura compensation process according to an embodiment.

Referring to FIG. 2, the data processing circuit 110 may transmit image data RGB having certain grayscale values to the source driver 120. In addition, the source driver 120 may convert these grayscale values into a data voltage Vd and supply the data voltage Vd to the display panel 140. In this case, gamma may be applied to the data voltage Vd.

In addition, luminance Lx of each pixel of the display panel 140 may be controlled according to the data voltage Vd. The luminance Lx of each pixel may be different from each other. A deviation of luminance Lx of pixels is also referred to as mura.

A camera device 220 may image the display panel 140, measure a luminance value for each pixel or area, and store the measured luminance values.

Also, a demura compensation device 210 may receive a digitized luminance value DLx from the camera device 220, and calculates a compensation value for resolving a mura phenomenon using the luminance value DLx of each pixel.

This process may be repeatedly performed for specific grayscale values. For example, regarding five major grayscale values, e.g., 32, 64, 128, 192, and 200, among 0 to 225 grayscale values, the luminance values DLx may be stored in the demura compensation device 210 for each pixel or each area.

The demura compensation device 210 may acquire a plurality of luminance values DLx corresponding to the plurality of grayscale values and calculate compensation values DCp corresponding to the plurality of grayscale values such that a mura phenomenon due to a difference between target luminance values and the luminance values DLx is resolved. Here, the target luminance values may be mainly determined according to luminance values of an area positioned in the middle of the display panel.

Also, the demura compensation device 210 may transmit the compensation values DCp to an external device so that the calculated compensation values DCp are stored in a memory of the data processing circuit 110.

Figure 3:
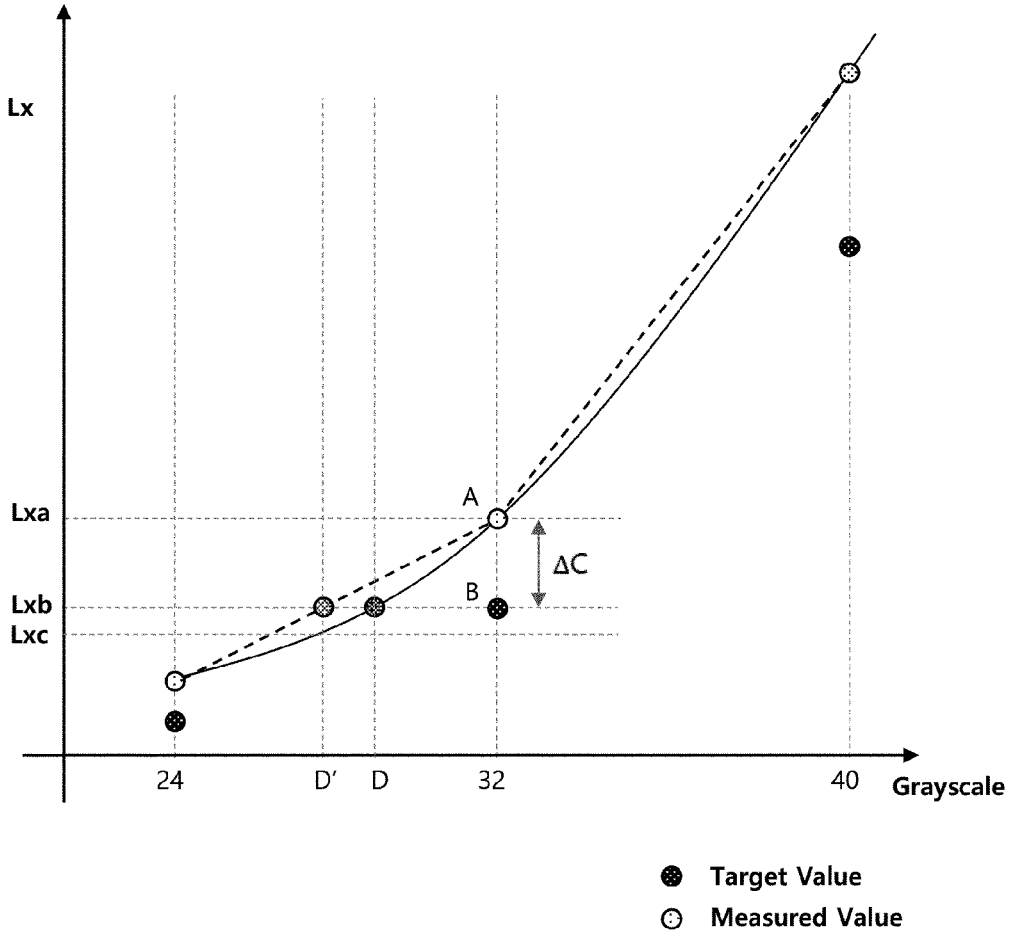
FIG. 3 is a view illustrating a general demura compensation process.

FIG. 3 is a view illustrating a general Demura compensation process.

In the example of FIG. 3, one area of the display panel represents a first luminance value Lxa with respect to grayscale value 32, and a target luminance value for demura compensation at the grayscale value 32 may be a second luminance value Lxb.

Since there is a difference ΔC between the measured luminance value Lxa and the target luminance value Lxb, the data processing circuit needs to compensate for the grayscale value 32 with a grayscale value D and then transmit the compensated grayscale value to the source driver. According to the measured gamma curve, i.e., the solid line in FIG. 3, when the grayscale value D is input, a pixel of the corresponding area may emit light with the second luminance value Lxb.

However, in order for the demura compensation device to check the gamma curve indicated by the solid line in FIG. 3, the demura compensation device has to measure luminance values for all grayscale values. Accordingly, a general demura compensation device calculates a compensated grayscale value using an interpolation function, i.e., the dotted line in FIG. 3, between the measured luminance values. In FIG. 3, a grayscale value calculated according to the interpolation function corresponds to D'.

In this method, the compensation grayscale value may be calculated relatively simply by using the interpolation function having the form of a linear function, but an actual luminance value of the grayscale value D' is a third luminance value Lxc, not the second luminance value Lxb, causing a problem that accuracy of compensation is lowered.

In order to increase the accuracy of compensation, the interpolation function may be configured as a second or higher order function, but the higher order function has a problem in that calculation is complicated and in some cases the accuracy is not increased.

In order to improve this problem, an embodiment of the present disclosure proposes a method of calculating a compensation grayscale value by mapping obtained luminance values to a log domain.

Figure 4:
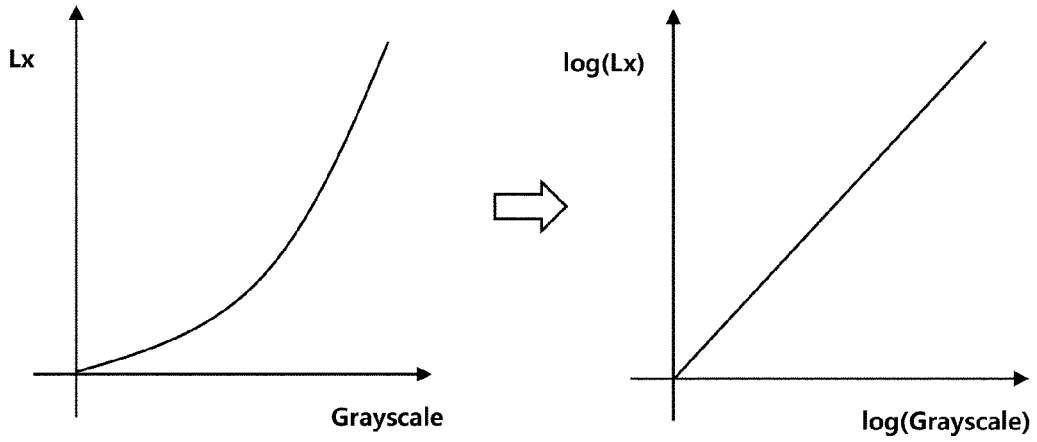
FIG. 4 is a view illustrating a shape of a gamma curve when converted into a log domain.

FIG. 4 is a view illustrating a form of a gamma curve when converted into a log domain.

In FIG. 4, the left is a graph illustrating luminance values for each grayscale value acquired when a display panel to which gamma is applied is imaged. Since gamma is applied to the display panel, the graph has a form of an exponential function.

The right in FIG. 4 is a graph in which a log (logarithm) is applied to a grayscale value and a luminance value. When a log is applied to the grayscale value and the luminance value as shown on the right of FIG. 4, the graph is changed linearly. In an embodiment, the convenience and accuracy of calculation may be improved by calculating a compensation grayscale value in the linear graph.

Figure 5:
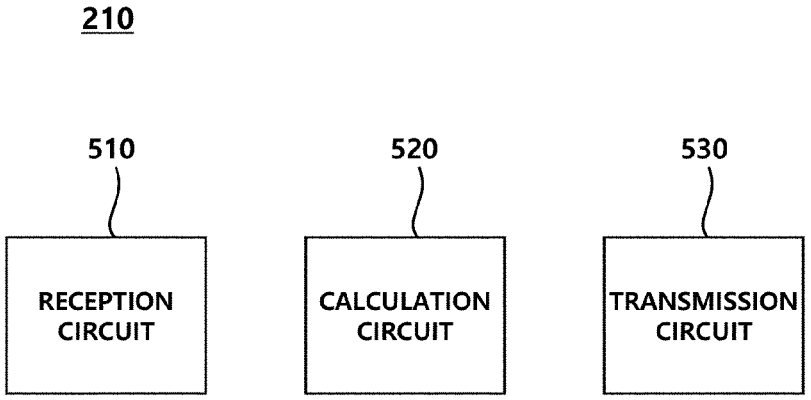
FIG. 5 is a configuration diagram of a demura compensation device according to an embodiment.

FIG. 5 is a configuration diagram of the demura compensation device according to an embodiment.

Referring to FIG. 5, the demura compensation device 210 may include a reception circuit 510, a calculation circuit 520, a transmission circuit 530, and the like.

The reception circuit 510 may acquire a plurality of luminance values corresponding to a plurality of grayscale values for each area of the display panel to which gamma is applied. The reception circuit 510 may receive luminance values through communication with the camera device.

The calculation circuit 520 may calculate compensation values for the grayscale values so that a mura phenomenon due to the difference between the target luminance values and the measured luminance values is resolved.

The calculation circuit 520 may map the measured luminance values to the log domain. Assuming that the grayscale values for which the luminance values are measured are previously determined, the calculation circuit 520 may calculate log luminance values by applying logs to the measured luminance values. Values (log target luminance values) acquired by applying the logs to the target luminance values may be stored in advance.

In the log domain, one axis may include log-applied grayscale values (log grayscale values), and the other axis may include log-applied luminance values (log luminance values).

Also, the calculation circuit 520 may generate interpolation functions between log luminance values in the log domain and match log target luminance values to the interpolation functions to generate log-applied compensation grayscale values (log compensated grayscale values).

Here, the interpolation functions may include a linear function.

Also, the calculation circuit 520 may calculate compensation grayscale values by applying inverse logs, e.g., an exponential function, to the logarithmic compensation grayscale values.

Also, the calculation circuit 520 may calculate a compensation value for converting a grayscale value, for which a luminance value was measured, into a compensation grayscale value. For example, the data processing circuit may generate a compensation grayscale value by applying the grayscale value to the linear function, and here, a gain value and an offset value applied to the linear function may be calculated as the compensation value.

The compensation values are finally inserted into the memory of the data processing circuit for driving the display panel. To this end, the transmission circuit 530 may transmit these compensation values to a device for storing the compensation values in the memory of the data processing circuit.

Figure 6:
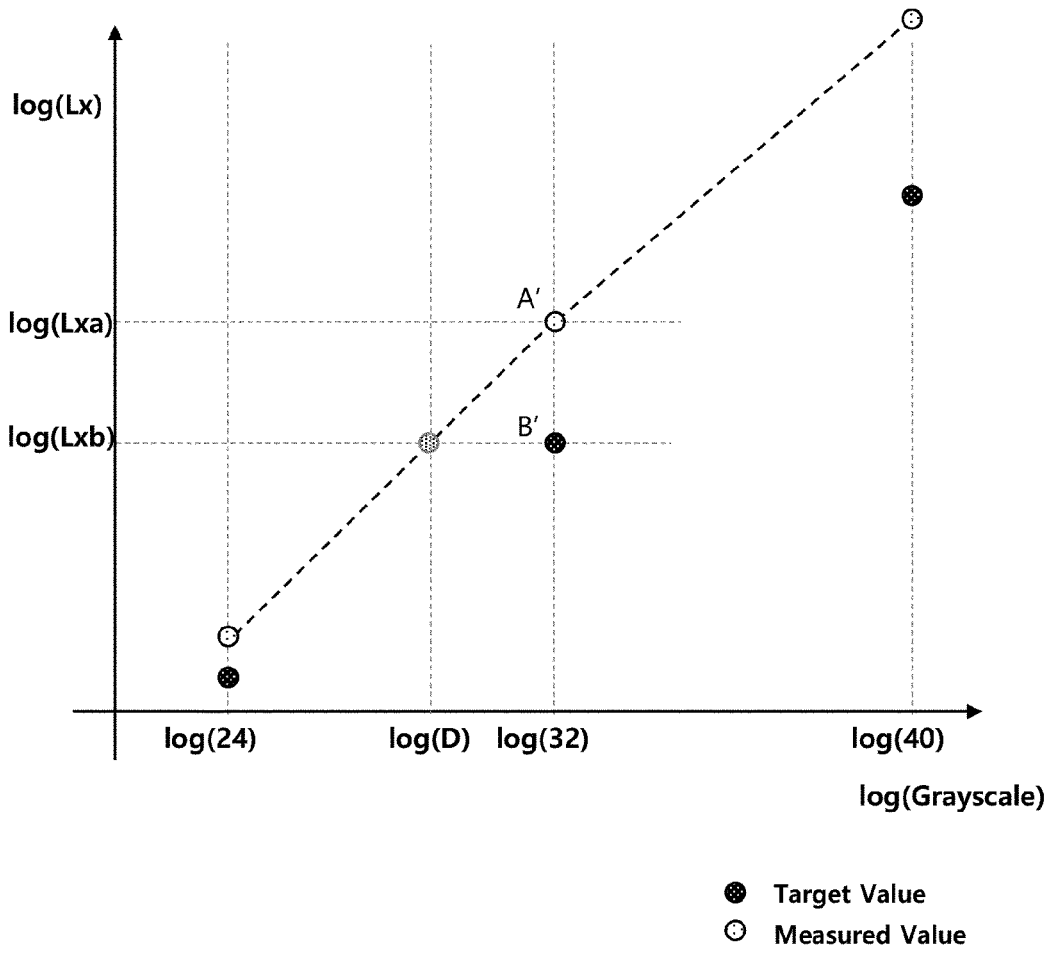
FIG. 6 is a view illustrating a method of calculating a compensation value in a log domain according to an embodiment.

FIG. 6 is a view illustrating a method of calculating a compensation value in a log domain according to an embodiment.

Referring to FIG. 6, measured luminance values may be mapped to a log domain in which one axis includes log grayscale values and the other axis includes log luminance values.

A luminance value measured for grayscale value 32 may be mapped to a first log luminance value log(Lxa) (refer to A' in the drawing). For the grayscale value 32, a log target luminance value may be mapped to a second log luminance value log(Lxb) (refer to B' in the drawing).

Also, in the interpolation function (the dotted line connecting the measured luminance values), a log grayscale value log(D) corresponding to the second log luminance value log(Lxb) may be calculated as a log compensation grayscale value. In addition, a compensation grayscale value D may be finally calculated by applying an inverse log to the log compensation grayscale value.

Also, the demura compensation device may calculate a gain value and an offset value for converting the grayscale value 32 with the compensation grayscale value D as compensation values.

The calculated compensation value may be stored in the memory of the data processing circuit and may be used for compensation of image data.

Figure 7:
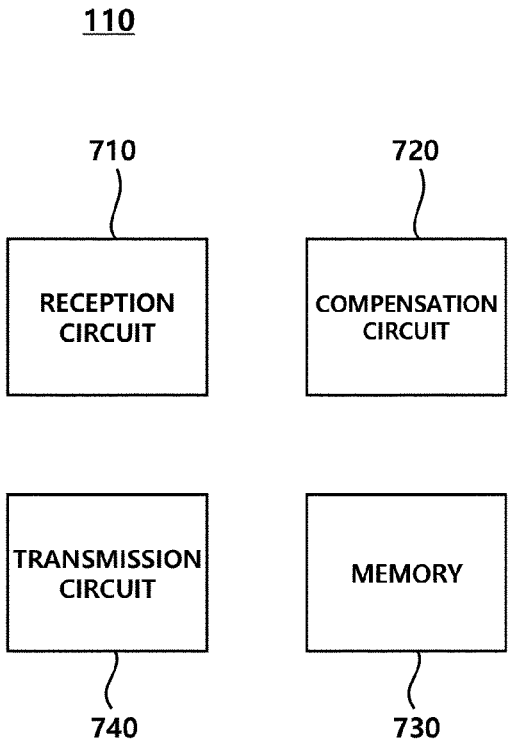
FIG. 7 is a block diagram of a data processing circuit according to an embodiment.

FIG. 7 is a block diagram of the data processing circuit according to an embodiment.

Referring to FIG. 7, the data processing circuit 110 may include a reception circuit 710, a compensation circuit 720, a memory 730, and a transmission circuit 740, and the like.

The reception circuit 710 may receive image data. The reception circuit 710 may receive the image data through communication with a host device or the like.

The compensation circuit 720 may convert the image data. The compensation circuit 720 may convert the image data by reflecting various matters. The compensation circuit 720 may convert the image data to compensate for deterioration of pixels and may convert the image data to add a specific effect to an image. In addition, the compensation circuit 720 may convert the image data for demura compensation.

The memory 730 may store compensation values for image data conversion. The memory 730 may store compensation values for demura compensation for each area. The memory 730 may store a compensation value for a specific grayscale value called a plane.

When a grayscale value included in the image data corresponds to the specific grayscale value, the compensation circuit 720 may convert the corresponding grayscale value according to a compensation value, calculate compensation values for grayscale values, other than the specific grayscale value, according to an interpolation technique, and convert the corresponding grayscale value with the calculated compensation values.

The compensation circuit 720 may recognize a position of a pixel corresponding to the grayscale value included in the image data, select an area according to the position, and determine compensation values for the corresponding area in the memory 730, and compensate for grayscale values.

The converted image data is generated according to the compensated grayscale values, and the transmission circuit 740 may transmit the converted image data to the source driver.

An embodiment has been described above. According to this embodiment, the demura compensation values may be accurately calculated through an uncomplicated process.

In the above exemplary systems, although the methods have been described on the basis of the flowcharts using a series of the steps or areas, the present disclosure is not limited to the sequence of the steps, and some of the steps may be performed at different sequences from the remaining steps or may be performed simultaneously with the remaining steps. Furthermore, those skilled in the art will understand that the steps shown in the flowcharts are not exclusive and may include other steps or one or more steps of the flowcharts may be deleted without affecting the scope of the present disclosure.

What is claimed is:

1. A demura compensation device comprising:

a reception circuit configured to acquire a plurality of luminance values corresponding to a plurality of grayscale values for one area of a display panel to which gamma is applied; and a calculation circuit configured to calculate compensation values for the grayscale values by mapping the plurality of luminance values to a log domain so that a mura phenomenon due to a difference between target luminance values and the plurality of luminance values is resolved, wherein one axis of the log domain includes gray scale values to which logs are applied and the other axis include luminance values to which logs are applied, wherein the calculation circuit is configured to generate compensation grayscale values by applying inverse logs to the calculated values in the log domain and generate the compensation values according to the compensation grayscale values.

2. The demura compensation device of claim 1, wherein the calculation circuit is configured to generate compensation grayscale values by generating interpolation functions corresponding to the luminance values and matching the target luminance values to the interpolation functions in the log domain, and generate the compensation values according to the compensation grayscale values.

3. The demura compensation device of claim 2, wherein the interpolation function includes a linear function.

4. The demura compensation device of claim 2, wherein the compensation values include a gain value and an offset value of a function converting the grayscale values into the compensation grayscale values.

5. The demura compensation device of claim 1, wherein the target luminance values are generated from luminance values of an area positioned in the middle of the display panel.

6. The demura compensation device of claim 1, wherein 2.0 to 2.8 gammas are applied to the display panel.

7. The demura compensation device of claim 1, wherein N×M (N and M are natural numbers) pixels are arranged in the one area.

8. A data processing circuit comprising:

a reception circuit configured to receive image data including grayscale values for each pixel arranged in a display panel;

a memory configured to store compensation values for the grayscale values for each area;

a compensation circuit configured to compensate for the grayscale values according to the compensation values and generate converted image data with the compensated grayscale values; and a transmission circuit configured to transmit the converted image data to a source driver, wherein the compensation values are calculated by mapping luminance values for the display panel to a log domain, wherein one axis of the log domain includes gray scale values to which logs are applied and the other axis include luminance values to which logs are applied, wherein the compensation values are generated according to compensation grayscale values and the compensation grayscale values are generated by applying inverse logs to the calculated values in the log domain.

9. The data processing circuit of claim 8, wherein the source driver is configured to drive the display panel using a digital-to-analog converter (DAC) to which gamma is applied.

10. The data processing circuit of claim 9, wherein the source driver is configured to generate or be supplied with a plurality of gamma voltages corresponding to 2.0 to 2.8 gammas, and the DAC is configured to convert a signal in a manner of selecting one of the plurality of gamma voltages.

11. The data processing circuit of claim 8, wherein the memory is configured to store the compensation values for specific grayscale values, and the compensation circuit is configured to calculate the compensation values for grayscale values, other than the specific grayscale values, according to an interpolation technique.

12. The data processing circuit of claim 8, wherein the areas each include N×M (N and M are natural numbers) pixels.

13. The data processing circuit of claim 12, wherein the compensation circuit is configured to select an area according to a position of each pixel and compensate for the grayscale values by determining the compensation values for a corresponding area in the memory.

* * * * *